US006909873B2

(12) United States Patent
Okubo

(10) Patent No.: US 6,909,873 B2
(45) Date of Patent: Jun. 21, 2005

(54) IMAGE FORMING APPARATUS WITH FIXING APPARATUS AND CONVEYING ROLLERS DOWNSTREAM OF THE FIXING APPARATUS. THE CONVEYING ROLLERS HAVING A PORTION WITH A RELEASING LAYER

(75) Inventor: Takateru Okubo, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/667,352

(22) Filed: Sep. 23, 2003

(65) Prior Publication Data

US 2004/0057765 A1 Mar. 25, 2004

(30) Foreign Application Priority Data

Sep. 25, 2002 (JP) ..... 2002-278910
Sep. 11, 2003 (JP) ..... 2003-319319

(51) Int. Cl.[7] ..... G03G 15/00
(52) U.S. Cl. ..... 399/406
(58) Field of Search ..... 399/406, 405

(56) References Cited

U.S. PATENT DOCUMENTS 6,330,419 B1 * 12/2001 Sano et al. ..... 399/322
6,430,386 B2 8/2002 Okubo et al. ..... 399/328
6,726,196 B2 * 4/2004 Kirino ..... 270/58.11

FOREIGN PATENT DOCUMENTS

JP 4-274474 9/1992
JP 5-119651 5/1993
JP 10-10908 1/1998
JP 2000-7180 1/2000
JP 2000-131983 5/2000
JP 2000-226146 8/2000

* cited by examiner

*Primary Examiner*—Quana Grainger
(74) *Attorney, Agent, or Firm*—Fitzpatrick, Cella, Harper & Scinto

(57) ABSTRACT

The invention is to provide an image forming apparatus capable of suppressing a waving of a recording material. For this purpose, there is provided an image forming apparatus having:

an image forming device for forming an image on a recording material;

a fixing device for fixing the image formed on the recording material; and a recording material conveying device which is provided at a downstream side of the fixing device in a moving direction of the recording material, the conveying device including a first roller having a first shaft and a second roller having a second shaft and maintained in contact with the first roller;

wherein the second roller includes a first portion provided in a vicinity of a passing reference of the recording material and maintained in contact with the first roller, and a second portion positioned farther from the reference than the first portion and having a diameter smaller than that of the first portion.

14 Claims, 9 Drawing Sheets

FIG. 3

| "FIXING AND DISCHARGING LOWER ROLLER" AND "BEHAVIOR OF TRANSFERRING MATERIAL" | |
|---|---|
| $\phi D1 = \phi D2$ | WAVINESS: GREAT |
| $0.8 < \phi D2 - \phi D1 \leqq 1.8$ | ○: GOOD |
| $1.8 < \phi D2 - \phi D1$ | CORNER-FOLD: OCCURRED |

IMAGE FORMING APPARATUS WITH FIXING APPARATUS AND CONVEYING ROLLERS DOWNSTREAM OF THE FIXING APPARATUS. THE CONVEYING ROLLERS HAVING A PORTION WITH A RELEASING LAYER

BACKGROUND OF THE INVENTION

1. Field of the Invention

The present invention relates to an image forming apparatus such as a printer or a copying apparatus utilizing a recording technology such as an electrophotographic process or an electrostatic recording process, and a fixing apparatus adapted to be mounted on such apparatus.

2. Description of the Related Art

An image forming apparatus such as a printer is usually provided, as described in Japanese Patent Application Laid-open No. 2000-226146, with a pair of rollers for guiding a recording material, having passed a fixing device, to a discharge tray. Such paired rollers may assume a form of "a single roller extended in a direction of a generatrix" provided on a rotary shaft, both in a roller coming into contact with a front surface of the recording material and a roller coming into contact with a rear surface of the recording material, or plural short rollers in the direction of generatrix on a rotary shaft, both in a roller coming into contact with a front surface of the recording material and a roller coming into contact with a rear surface of the recording material.

However, in either form, there is encountered a drawback that a conveying operation of the recording material under a pinching pressure uniform in a direction of width (direction perpendicular to a conveying direction) tends to induce a waviness or an undulation of the recording material (FIGS. 8A and 8B).

Also, a front corner of the recording material may be folded or dog-eared depending on an entry state of the recording material into the paired rollers (FIGS. 8A and 8B), and such folding need to be avoided.

SUMMARY OF THE INVENTION

The present invention has been made in consideration of the aforementioned drawbacks, and has an object of providing an image forming apparatus and a fixing apparatus capable of suppressing a waviness in a recording material.

Another object of the present invention is to provide an image forming apparatus and a fixing apparatus capable of suppressing a folding of a corner at a front end of a recording material.

Still another object of the present invention is to provide an image forming apparatus including:

image forming means which forms an image on a recording material;

fixing means which fixes the image formed on the recording material;

recording material conveying means provided at a downstream side of the fixing means in a moving direction of the recording material, the conveying means including a first roller having a first shaft and a second roller having a second shaft and maintained in contact with the first roller;

wherein the second roller has a first portion provided in a vicinity of a passing reference position of the recording material and maintained in contact with the first roller, and a second portion positioned farther than the first portion from the reference position and having a diameter smaller than in the first portion.

Still another object of the present invention is to provide a fixing apparatus including:

fixing means which fixes an image formed on a recording material;

recording material conveying means provided at a downstream side of the fixing means in a moving direction of the recording material, the conveying means including a first roller having a first shaft and a second roller having a second shaft and maintained in contact with the first roller;

wherein the second roller has a first portion provided in a vicinity of a passing reference position of the recording material and maintained in contact with the first roller, and a second portion positioned farther than the first portion from the reference position and having a diameter smaller than in the first portion.

Still other objects of the present invention will become fully apparent from the following detailed description which is to be taken in conjunction with the accompanying drawings.

BRIEF DESCRIPTION OF THE DRAWINGS

FIG. 3 is a table showing a relationship between a roller diameter and the behavior of a recording material;

DETAILED DESCRIPTION OF THE PREFERRED EMBODIMENTS (First Embodiment)

Figure 1:
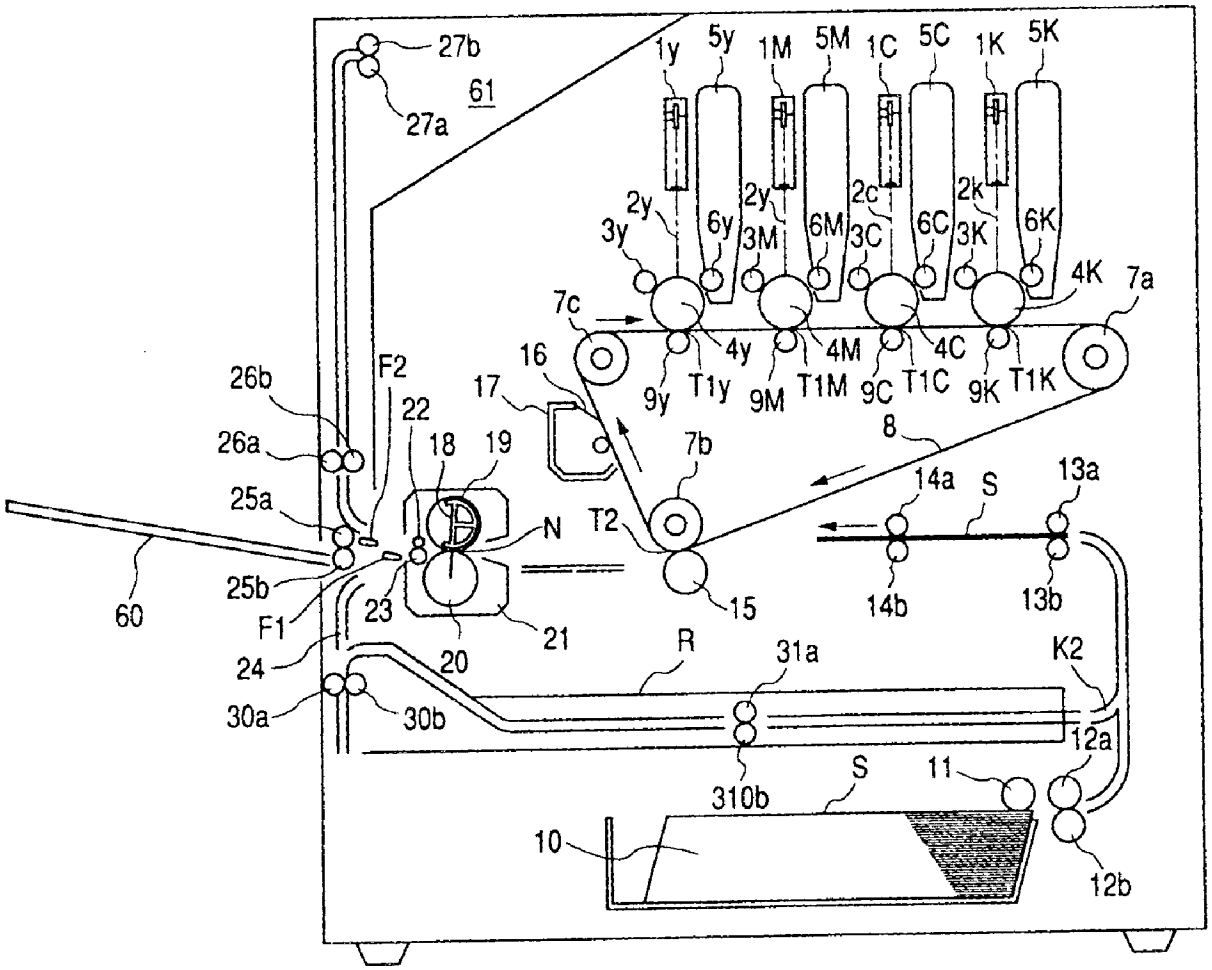
FIG. 1 is a schematic cross-sectional view of an image forming apparatus embodying the present invention.

In the following there will be explained, with reference to accompanying drawings, embodiments of the image forming apparatus and the fixing apparatus of the present invention. FIG. 1 is a schematic cross-sectional view of an image forming apparatus embodying the present invention. In the following, there will be explained construction, following a sequence of image formation.

At first there will be given an explanation on image forming means which forms a toner image on a recording material. Laser scanner units (1Y, 1M, 1C, 1K) respectively corresponding to yellow, magenta, cyan and black colors emit laser beams (2Y, 2M, 2C, 2K) according to image data of respective colors to record latent images corresponding to the image-data, on photosensitive drums (4Y, 4M, 4C, 4K) of which surfaces are uniformly charged by charging rollers (3Y, 3M, 3C, 3K). Then, such latent images are developed in an order of yellow, magenta, cyan and black by unrepresented toners of respective colors contained in developing apparatus (5Y, 5M, 5C, 5K) through developing sleeves (6Y, 6M, 6C, 6K) of respective colors. The toner images formed on four photosensitive drums are transferred onto an intermediate transfer belt 8, rotated by belt driving rollers (7*a*, 7*b*, 7*c*) counterclockwise (direction indicated by an arrow) in the drawing, in succession on primary transfer points (T1Y, T1M, T1C, T1K) and thus superposed. There are provided back-up rollers 9Y, 9M, 9C, 9K for transferring the toner images from the photosensitive drums onto the intermediate transfer member.

On the other hand, a recording material S fed from a feed cassette 10 by a feed roller 11 is conveyed by pairs of conveying rollers (12*a*, 12*b*), (13*a*, 13*b*), (14*a*, 14*b*) in a direction indicated by an arrow, and is conveyed to a secondary transfer point T2. At such point T2, a full-color toner image on the intermediate transfer member is collectively transferred (secondary transfer) on the recording material, which is conveyed by pinching between a transfer roller 15, constituted of a foamed member wound around a metal shaft, and a belt driving roller 7*b*.

Toner, which is not transferred but remains on the surface of the intermediate transfer belt 8, is recovered into a cleaner 17 by a cleaning blade 16 positioned in contact with the intermediate transfer belt 8, and is finally collected in an unrepresented used toner container.

The recording material S bearing an image after the secondary transfer passes through a fixing nip portion N formed between a fixing film 19 and a pressure roller 20. Thus the toner image on the recording material is fixed thereto by heating. In the present embodiment, there is employed a fixing apparatus of electromagnetic induction type in which the fixing film 19 itself generates heat. An exciting coil unit 18 is provided inside the fixing film 19.

After passing the fixing nip portion N of the fixing apparatus 21, the recording material is conveyed by a pair of conveying rollers (conveying means) 22, 23, driven by an unrepresented drive source through gear G (cf. FIG. 2) and positioned immediately behind the fixing nip. A lower roller 23 (second roller) is a driving roller, and an upper roller (first roller) 22 is an idler roller which is rotated following the rotation of the lower roller 23. The conveying means 22, 23 are provided in the fixing apparatus 21. Also the fixing apparatus is detachably mounted on a main body of the image forming apparatus.

In case of a one-side print mode, the recording material having passed the fixing nip N and the conveying means 22, 23 is discharged through a pair of discharge rollers 25*a*, 25*b* onto a face-up tray 60, or pairs of discharge rollers 26*a*, 26*b*, 27*a*, 27*b* onto a face-down tray 61. In case an image is formed only on one side of the recording material, the upper roller (first roller) 22 comes into contact with the image.

In case of a two-side print mode, a two-side flapper F1 is so moved by an unrepresented solenoid that the recording material after passing the fixing nip is conveyed to a two-side unit. Then the recording material, bearing an image on a front surface (first surface) and having passed the paired conveying rollers 22, 23, is conveyed after passing a conveying path 24 to a position where a rear end of 20 mm of the recording material remains in a nip portion between a two-side reversing roller 30*a* and a two-side reversing opposed roller 30*b*. Thereafter, the paired two-side reversing rollers 30*a*, 30*b* are reversed to convey the recording material in a two-side unit R, and the recording material is re-fed by a pair of two-side conveying rollers 31*a*, 31*b* to a re-feed conveying path K2. Thereafter, the recording material is conveyed in a direction indicated by an arrow by pairs of conveying rollers (13*a*, 13*b*), (14*a*, 14*b*), and, after a transfer of an image on a rear surface (second surface) of the recording material S, it again passes the fixing nip N in the fixing apparatus 21 whereby the image is fixed to the recording material S. Subsequently it is conveyed by the lower roller 23 and the upper roller 22, while a branching flapper F2 is rotated by an unrepresented solenoid in such a manner that the recording material is discharged to a discharge port 60 or 61 designated by the user, whereby the recording material is conveyed and discharged by respective pairs of the discharge rollers (25*a*, 25*b*), (26*a*, 26*b*) and (27*a*, 27*b*).

In the following, there will be explained a configuration of the upper roller 22 and the lower roller 23 for suppressing a waving and a corner folding of the recording material. Also there will be explained a configuration of the upper roller 22 and the lower roller 23 for suppressing an image deterioration in case of a high coverage print on the recording material. In the image forming apparatus of the present embodiment, a center in the direction of the width (direction perpendicular to the conveying direction) of the recording material is taken as a conveying reference (passing reference).

Figure 2:
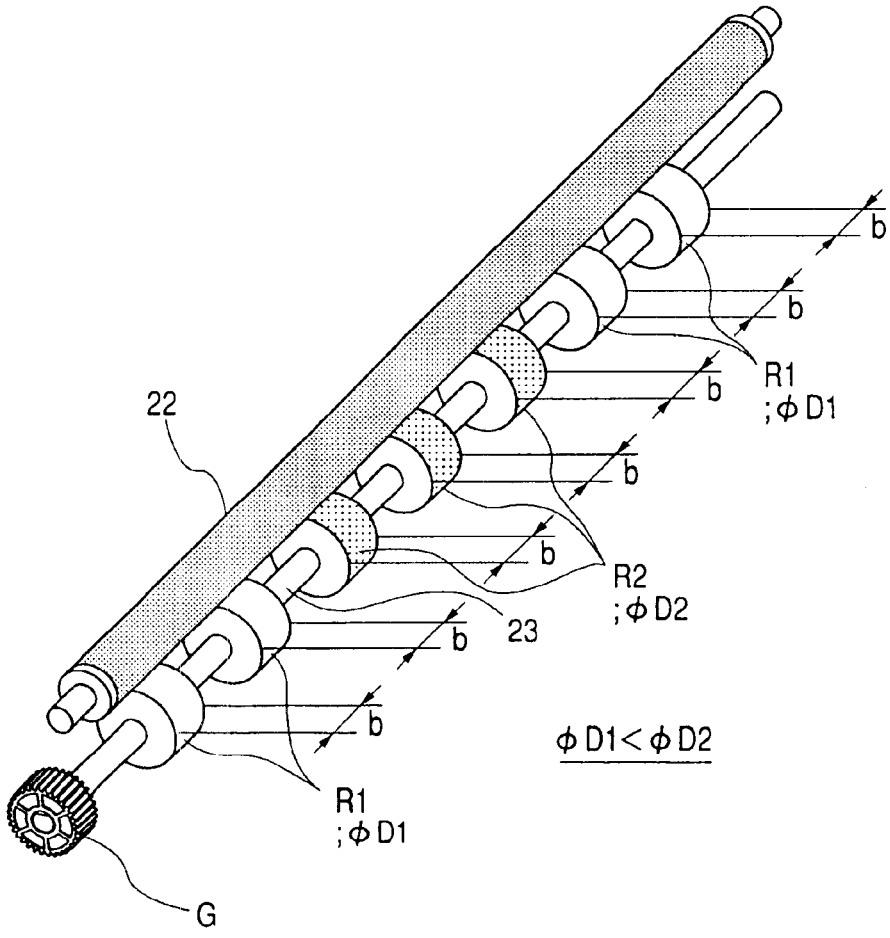
FIG. 2 is a perspective view of paired rollers in a first embodiment immediately after a fixing nip.

As shown in FIG. 2, the upper roller (first roller) 22 is provided, on an external periphery of the roller, with a releasing layer (surface layer) formed by a fluorinated resin, and a diameter of the roller 22 is uniform along a longitudinal direction thereof. The roller 22 of the present embodiment is constituted of an aluminum metal rod (first shaft) and a tube of a fluorinated resin (PFA) provided thereon. The roller of such configuration provides advantages of easier manufacture with a reduced cost. However, there may also be adopted a configuration of forming an elastomer layer such as of silicone rubber on the first shaft and further forming a releasing layer. On the other hand, the lower roller (second roller) 23 is constituted, on a roller rotary shaft, of silicone rubber rollers divided into seven portions and each having a width b in the axial direction. Three central rollers R2 (first portion) provided in the vicinity of the passing reference of the recording material have a diameter $\phi D2$, while four end rollers R1 (second portion) provided distant from the passing reference of the recording material has a diameter $\phi D1$ ($\phi D1<\phi D2$). The roller R2 is provided, on the external periphery, with a releasing layer (surface layer) of fluorinated resin. The roller R2 of the present embodiment is formed by covering a silicone rubber roller with a tube of fluorinated resin (PFA). The roller R1 is not provided with a surface layer of fluorinated resin and silicone rubber is exposed. In a state where the recording material is not conveyed, the rollers R2 (first portion) is in contact with the upper roller (first roller) 22, but the rollers R1 (second portion) is not in contact with the upper roller (first roller) 22 and have a gap to the upper roller (first roller) 22. Also between the upper roller 22 and the lower roller 23, there is applied a small pressure (30 g in the present embodiment) by unrepresented springs.

Figure 8A:
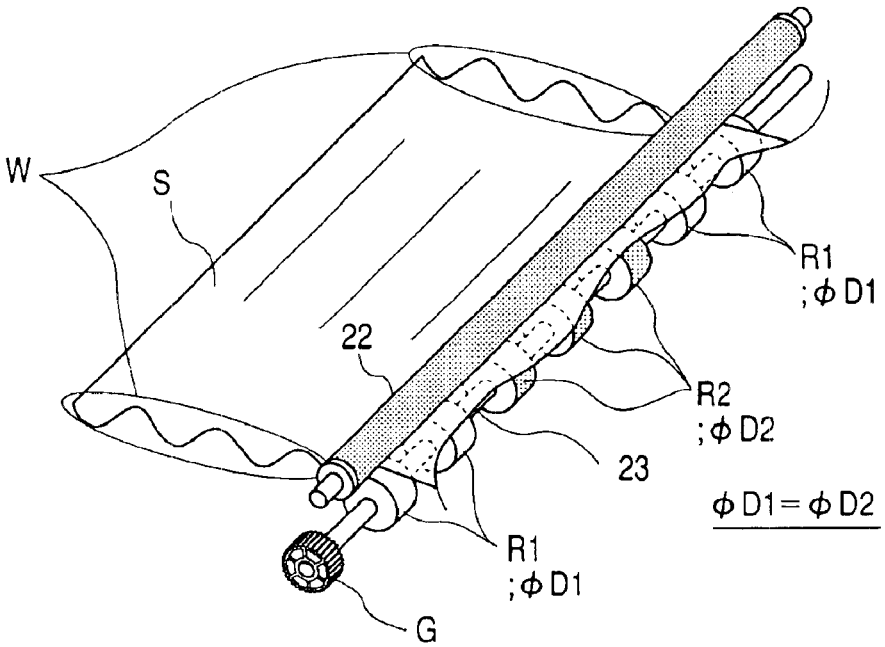
FIGS. 8A and 8B are perspective views showing a wavy state and a corner-folded state of a recording material.
Figure 8B:
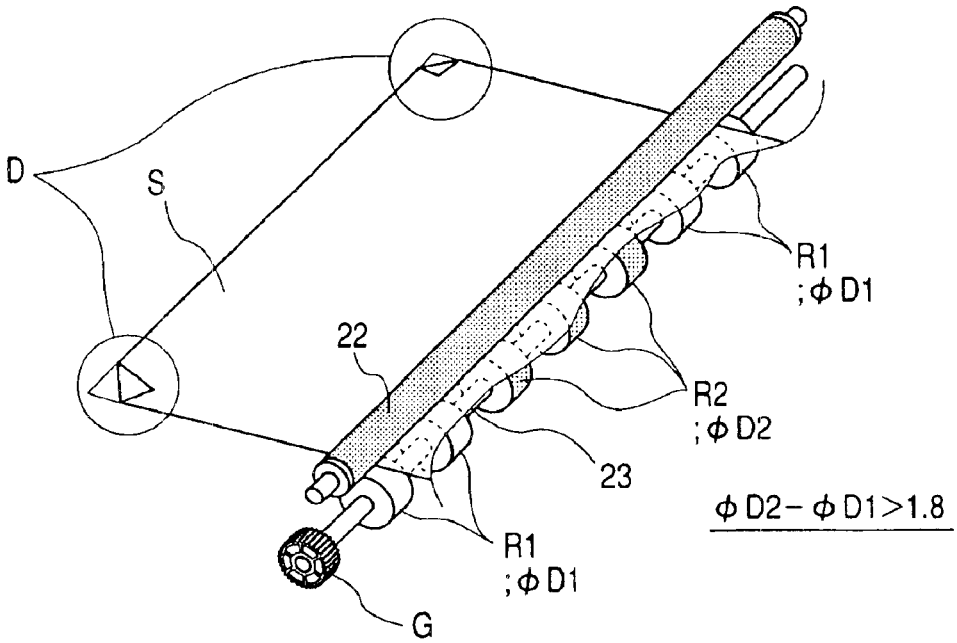
Figure 9:
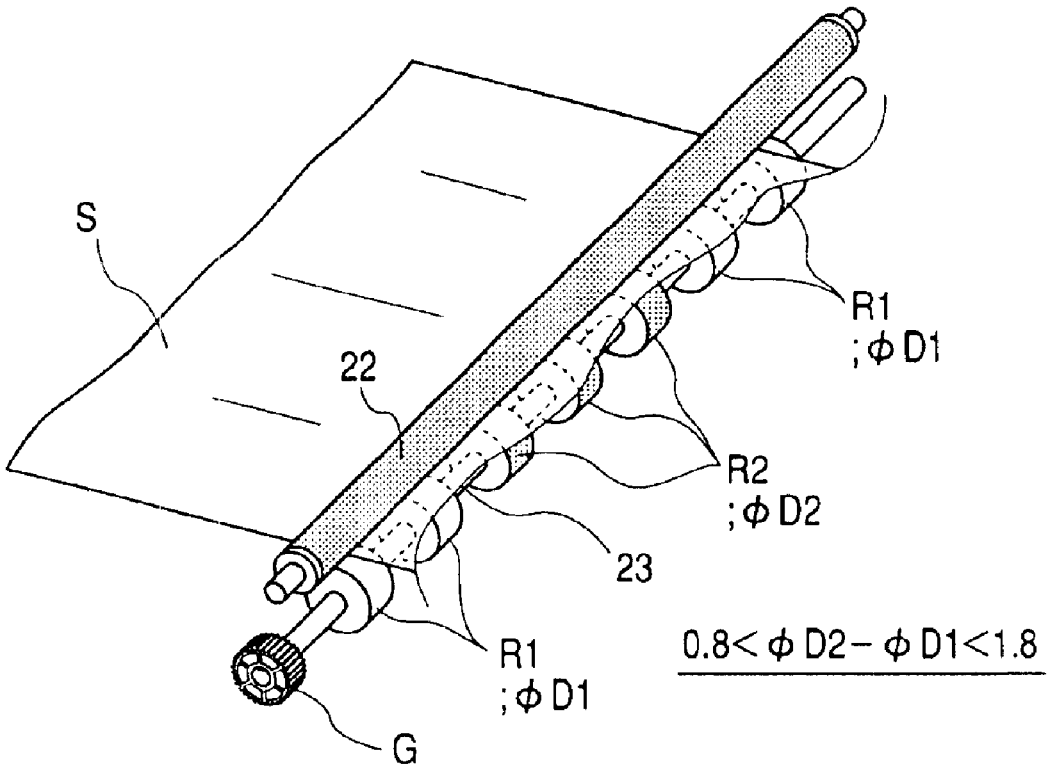
FIG. 9 is a perspective view showing a state in which a recording material is given a rigidity to suppress a waving and a corner folding in a front end.

FIG. 3 is a view showing the relationship between the roller diameter and the behavior of the recording material. As shown in FIG. 3, in case of a configuration in which the first portion (R2) and the second portion (R1) of the lower roller 23 have a same diameter and all the first portion and the second portion of the lower roller 23 are contacted with the upper roller 22 with a uniform pressure, the recording material shows a strong waviness W as shown in an upper part of FIGS. 8A and 8B. Also in case the second portion (R1) of the lower roller 23 has an excessively small diameter to cause an excessively large gap to the upper roller 22, a corner folding D is generated at the front end of the recording material as shown in a lower part of FIGS. 8A and 8B. Consequently, a difference between ϕD2 and ϕD1 is preferably within a range from 0.8 mm to 1.8 mm. In the present embodiment, ϕD2 is made larger by 1 mm than ϕD1. Thus, in a state where the recording material is not pinched between the upper roller 22 and the lower roller 23, the first portion (R2) of the lower roller 23 is in contact with the upper roller 22 while the second portion (R1) has an appropriate gap to the upper roller 22. In such configuration, while the recording material is conveyed by the upper roller 22 and the lower roller 23 as shown in FIG. 9, the recording material is given a rigidity at a boundary between the first portion (R2) and the second portion (R1) of the lower roller 23, thereby suppressing the waviness in the recording material. Also, the corner folding is not generated at the front end of the recording material since the gap is small between the second portion (R1) of the lower roller 23 and the upper roller 22.

Also since the upper roller 22 is provided with the releasing surface layer, the toner fixed but not completely solidified on the first recording surface of the recording material S in a one-side recording is prevented from sticking to the upper roller 22, whereby the image is prevented from being deteriorated, while, in a two-side recording, the toner not completely fixed does not stick to the lower roller 23 in contact with the first recording surface of the recording material nor to the upper roller 22 in contact with the second recording surface of the recording material, whereby the image can be prevented from deterioration.

Also, among seven rubber rollers of the lower roller 23, use of different diameters of R1: ϕD1 and R2: ϕD2 allows to control the behavior of the recording material, and a releasing layer is not provided on all the rollers but only in the rollers R2 coming in contact with the upper roller, thereby realizing an effect of cost reduction. Also a relationship ϕD1<ϕD2 allows to suppress the waving of the recording material on both end portions thereof in the direction of the roller shaft. In particular, a configuration in which the rollers R2 are maintained in contact with the upper roller 22 while the rollers R1 are not in contact with the upper roller 22 enhances the effect of suppressing the waving on both ends of the recording material.

Figure 4:
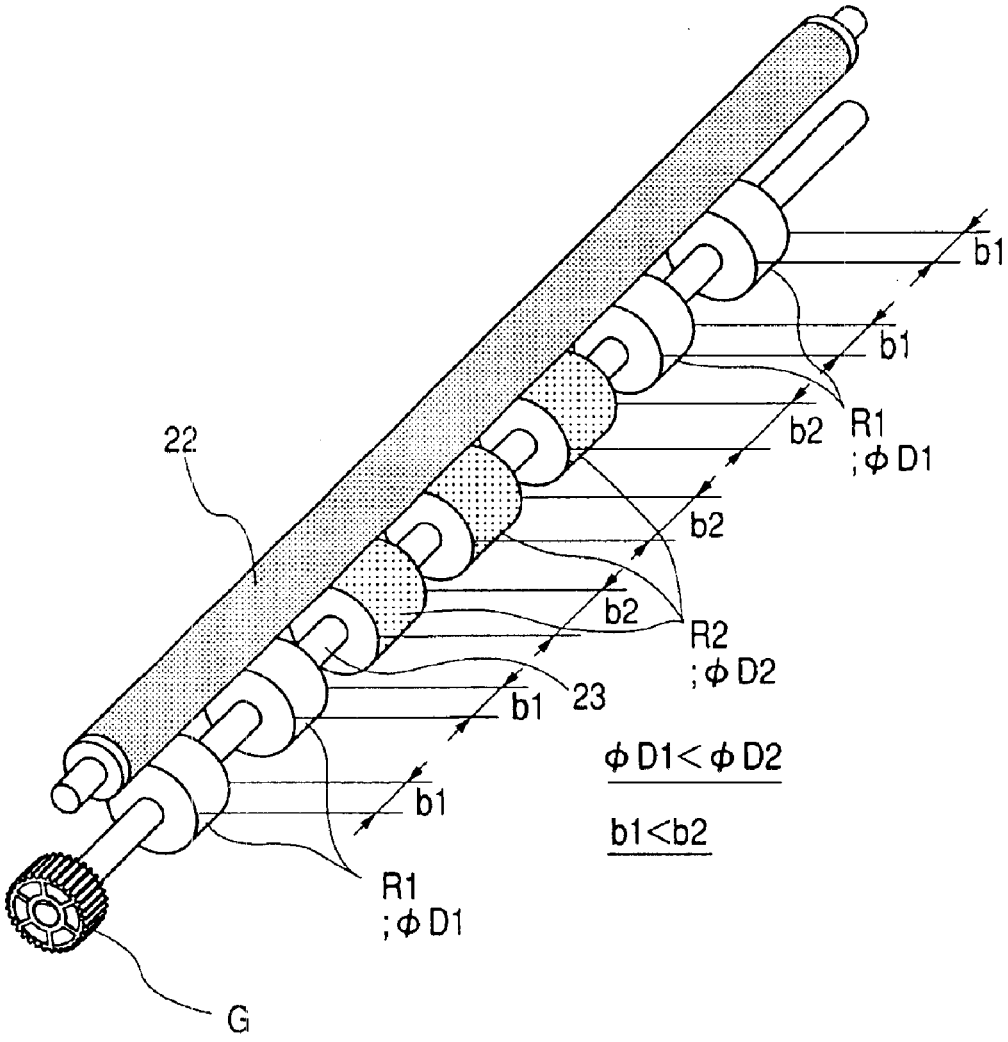
FIG. 4 is a perspective view of paired rollers in which, within a lower roller, a width of roller having a surface layer of a fluorinated resin is made larger than a width of a roller without a surface layer of a fluorinated resin.

Furthermore, in the lower roller 23, the rollers R2 may have a width b2 satisfying a relationship b2>b1 where b1 is a width of the rollers R1, as shown in FIG. 4. In this manner, it is rendered possible to increase the conveying power without changing the total load to the pair of the upper roller 22 and the lower roller 23, and to improve a conveying margin for a thin paper or the like. In such situation, a conveying operation is sufficiently possible in case a maximum width of contact between the lower roller 23 and the upper roller 22 (namely a width of the first portion R2 of the lower roller) is equal to or larger than the width of a maximum passable sheet.

The configuration explained above allows to provide a fixing apparatus and an image forming apparatus of a low running cost, capable of preventing a waving or a corner folding of the recording material or an image deterioration.

Figure 5:
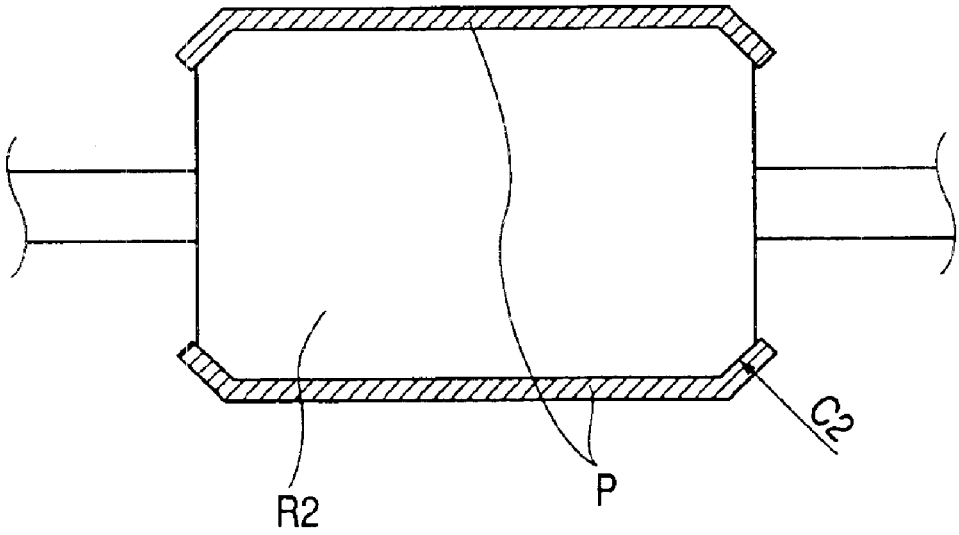
FIG. 5 is a cross-sectional view of an example in which a fluorinated resin tube is employed as a fluorinated resin surface layer.

In the following there will be explained a method of forming a releasing layer to the lower roller 23. In the present embodiment, for forming a releasing layer on a silicone rubber roller, there is employed a method of covering with a PFA tube. As shown in FIG. 5, a face C of a width of 2 mm is provided on each end face of the roller, thereby allowing a PFA tube P to shrink thermally and to cover the roller in a more wrap-around manner. Also, since no adhesive is employed, a disassembling is made easier to improve a recycling property when the apparatus is recovered at the end of the service life.

The above-described configuration allows to produce a lower roller of a lower cost, an improved matching to the environment and a longer service life without employing an adhesive material, thus enabling stable image formation to the end of a service life of the fixing apparatus.

(Second Embodiment)

Figure 6:
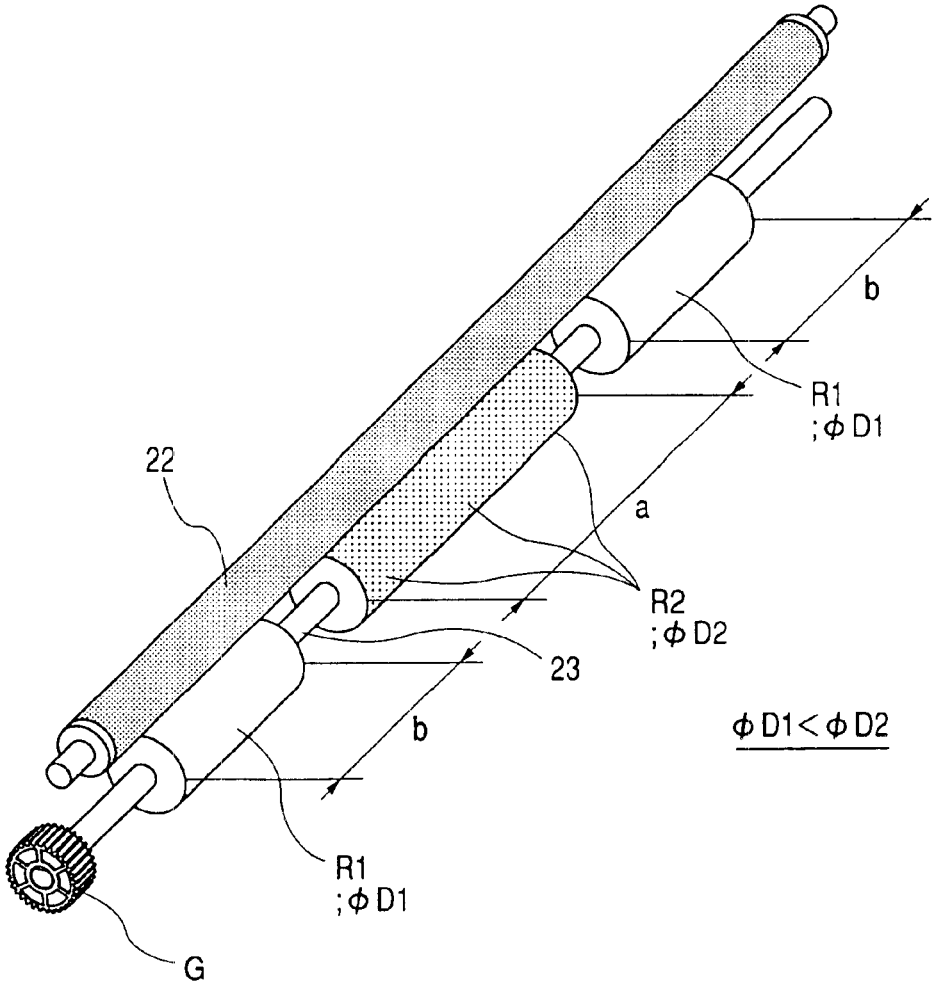
FIG. 6 is a perspective view of paired rollers constituting a second embodiment and employing a lower roller divided in three portions.

In the following, a second embodiment of the present invention will be explained with reference to FIG. 6.

In contrast to the first embodiment in which the lower roller 23 is divided into seven portions, it is divided into three portions in the present embodiment. As in the first embodiment, a second portion (R2) of the lower roller 23 is smaller in diameter than in a first portion (R2). Also a surface releasing layer is provided only in the first portion, while an elastic layer is exposed externally in the second portion. A width a of the first portion (R2) is made equal to or larger than ⅓ of a recording material passing area.

Such configuration also allows to obtain effects similar to those in the first embodiment.

(Third Embodiment)

Figure 7A:
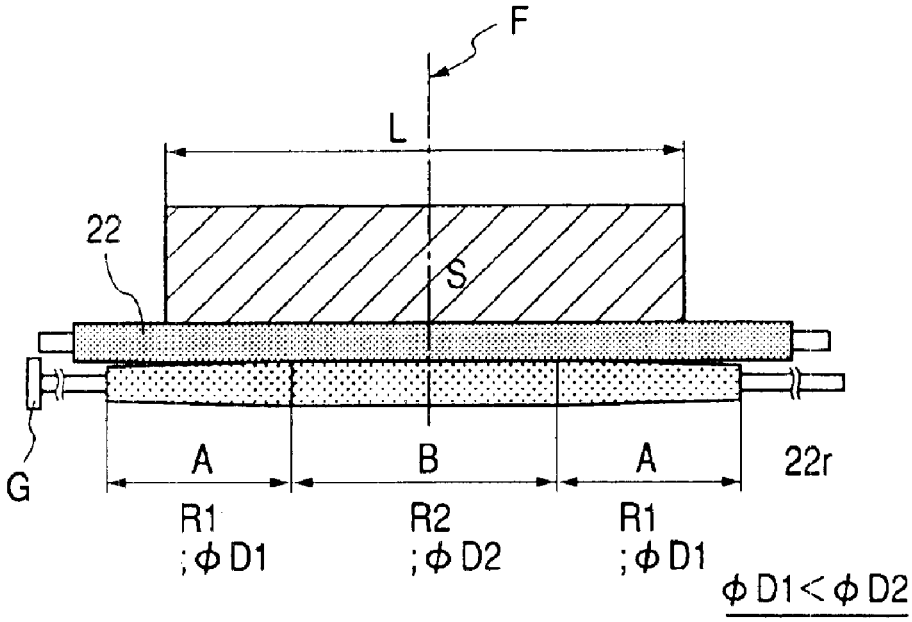
FIGS. 7A and 7B are perspective views of paired rollers constituting a third embodiment and employing a lower roller with a crowned shape.
Figure 7B:
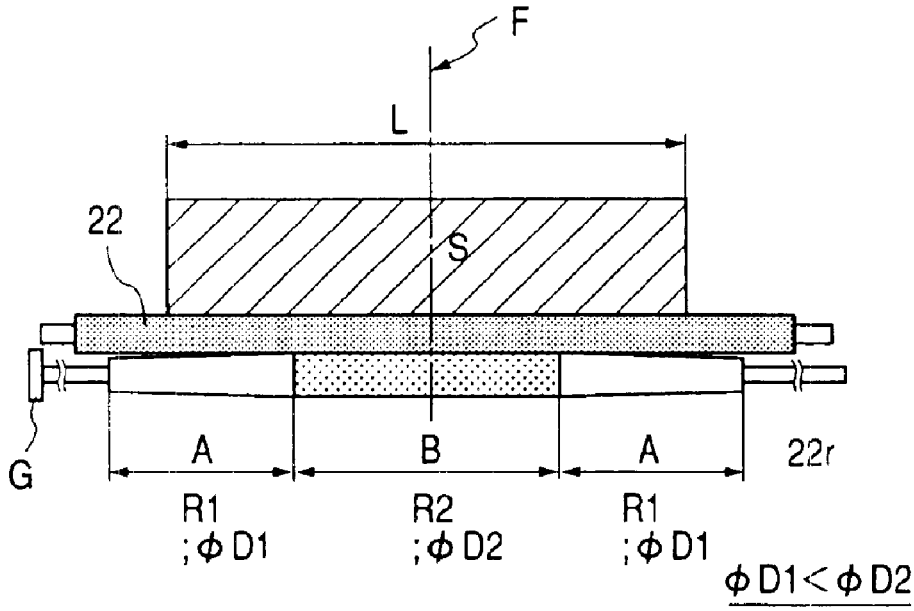

In the following, a third embodiment of the present invention will be explained with reference to FIGS. 7A and 7B.

In the present embodiment, the lower roller 23 is not divided but has a crowned shape having a smaller diameter in the vicinity of both ends. A first portion (R2) of the lower roller 23 has a uniform diameter over a range B, while second portions (R1) is so shaped that the diameter becomes gradually smaller toward the end. A width of the first portion (R2) is made equal to or larger than ⅓ of a recording material passing area. In FIGS. 7A and 7B, an upper portion shows a configuration in which a surface releasing layer is provided over the entire lower roller 23, while a lower portion shows a configuration in which a surface releasing layer is provided only in the first portion (R2). F indicates a conveying reference for the recording material.

Such configuration also allows to obtain effects similar to those in the first embodiment.

The present invention is not limited to the foregoing embodiments but includes any and all modifications within the technical concept.

What is claimed is:

1. An image forming apparatus comprising:

image forming means which forms an image on a recording material;

fixing means which fixes the image formed on the recording material; and recording material conveying means which is provided at a downstream side of said fixing means in a moving direction of the recording material, said conveying means including a first roller having a first shaft and a second roller having a second shaft and maintained in contact with said first roller;

wherein said second roller includes a first portion provided in a vicinity of a passing reference of the recording material and maintained in contact with said first roller, and a second portion positioned farther from the reference than the first portion and having a diameter smaller than that of the first portion, wherein the first portion includes an elastic layer and a surface releasing layer covering the elastic layer, and the second portion does not include a surface releasing layer whereby an elastic layer is exposed.

2. An image forming apparatus according to claim 1, wherein the second portion has a gap to said first roller.

3. An image forming apparatus according to claim 1, wherein a difference in diameters of the second portion and the first portion is equal to or larger than 0.8 mm and equal to or smaller than 1.8 mm.

4. An image forming apparatus according to claim 1, wherein, in case said image forming means forms the image only on one side of the recording material, said first roller is in contact with the image.

5. An image forming apparatus according to claim 1, wherein said first roller has a continuous shape without a division along said first shaft, while said second roller has a shape divided into plural portions along said second shaft.

6. An image forming apparatus according to claim 1, wherein said first roller has a continuous shape without a division along said first shaft, while said second roller has a continuous shape without a divison along said second shaft and becoming smaller in diameter as a distance from the reference increases.

7. An image forming apparatus according to claim 1, wherein the second portion is provided within a passing area of the recording material.

8. An image forming apparatus according to claim 1, wherein the first portion has a width, along said second shaft, equal to or larger than ⅓ of a passing area of the recording material.

9. An image forming apparatus according to claim 1, wherein said conveying means is provided immediately behind said fixing means, in the moving direction of the recording material.

10. An image forming apparatus according to claim 1, wherein said second shaft is provided, at an end portion thereof, with a gear for receiving a driving power from a drive source provided in said apparatus, and said first roller rotates following a rotation of said second roller.

11. An image forming apparatus according to claim 1, wherein said apparatus is also capable of forming an image on a rear side of the recording material by reversing the recording material.

12. An image fixing apparatus comprising:

fixing means which fixes an image formed on a recording material; and recording material conveying means which is provided at a downstream side of said fixing means in a moving direction of the recording material, said conveying means including a first roller having a first shaft and a second roller having a second shaft and maintained in contact with said first roller;

wherein said second roller includes a first portion provided in a vicinity of a passing reference of the recording material and maintained in contact with said first roller, and a second portion positioned farther from the reference than the first portion and having a diameter smaller than that of the first portion, wherein the first portion includes an elastic layer and a surface releasing layer covering the elastic layer, and the second portion does not include a surface releasing layer whereby an elastic layer is exposed.

13. An image forming apparatus comprising:

an image forming means which forms an image on a recording material;

fixing means which fixes the image formed on the recording material; and recording material conveying means which is provided at a downstream side of said fixing means in a moving direction of the recording material, said conveying means including a first roller having a first shaft and a second roller having a second shaft and maintained in contact with said first roller, wherein said second roller includes a first portion provided in a vicinity of a passing reference of the recording material and maintained in contact with said first roller, and a second portion positioned farther from the reference than the first portion and having a diameter smaller than that of the first portion, and wherein the first portion has a width, along said second shaft, equal to or larger than ⅓ of a passing area of the recording material.

14. An image fixing apparatus comprising:

fixing means which fixes an image formed on a recording material; and recording material conveying means which is provided at a downstream side of said fixing means in a moving direction of the recording material, said conveying means including a first roller having a first shaft and a second roller having a second shaft and maintained in contact with said first roller, wherein said second roller includes a first portion provided in a vicinity of a passing reference of the recording material and maintained in contact with said first roller, and a second portion positioned father from the reference than the first portion and having a diameter smaller than that of the first portion, and wherein the first portion has a width, along said second shaft equal to or larger than ⅓ of a passing area of the recording material.

* * * * *

UNITED STATES PATENT AND TRADEMARK OFFICE

CERTIFICATE OF CORRECTION

PATENT NO. : 6,909,873 B2
DATED : June 21, 2005
INVENTOR(S) : Takateru Okubo

It is certified that error appears in the above-identified patent and that said Letters Patent is hereby corrected as shown below:

Title page, Item [54] and Column 1, line 4,
Title, "APPARATUS." should read -- APPARATUS, --.

Column 8,
Line 44, "father" should read -- farther --.

Signed and Sealed this

Eighth Day of November, 2005

JON W. DUDAS
*Director of the United States Patent and Trademark Office*